US007730655B2

(12) United States Patent
Spuhr

(10) Patent No.: US 7,730,655 B2
(45) Date of Patent: Jun. 8, 2010

(54) SIGHT MOUNT FOR FIRE ARMS

(75) Inventor: Håkan Spuhr, Dalby (SE)

(73) Assignee: GS Development AB, Malmo (SE)

( * ) Notice: Subject to any disclaimer, the term of this patent is extended or adjusted under 35 U.S.C. 154(b) by 719 days.

(21) Appl. No.: 10/588,411

(22) PCT Filed: Mar. 2, 2005

(86) PCT No.: PCT/SE2005/000297

§ 371 (c)(1),
(2), (4) Date: Apr. 19, 2007

(87) PCT Pub. No.: WO2005/085744

PCT Pub. Date: Sep. 15, 2005

(65) Prior Publication Data

US 2008/0034638 A1 Feb. 14, 2008

(30) Foreign Application Priority Data

Mar. 3, 2004 (SE) ..... 0400519

(51) Int. Cl.
*F41G 1/38* (2006.01)

(52) U.S. Cl. ..... 42/127; 42/124

(58) Field of Classification Search ..... 42/124, 42/127

See application file for complete search history.

(56) References Cited

U.S. PATENT DOCUMENTS

| | | | |
|---|---|---|---|
| 1,710,547 | A | 4/1929 | Meise |
| 2,545,419 | A | 3/1951 | Platt |

FOREIGN PATENT DOCUMENTS

| | | |
|---|---|---|
| DE | 962 864 | 4/1957 |
| FR | 2 706 198 | 12/1994 |
| FR | 2 813 664 | 3/2002 |

*Primary Examiner*—Troy Chambers
(74) *Attorney, Agent, or Firm*—Merchant & Gould P.C.

(57) ABSTRACT

A sight mount for fire arms comprises a base part (10) to be mounted on a fire arm, and an upper part (11) to have a sight mounted thereon. The upper part is pivoted relative to the base part for movement about an axis between a first position corresponding to the operative position of the sight, wherein a projection (33) on the, upper part or the base part engages a groove (29) on the other part, and a second position transverse to the first position, wherein the projection is disengaged from the groove to allow the upper part to be separated from the base part. A latch (21) is spring biased to an engaged position preventing pivoting of the upper part, and against the spring bias can be brought into a disengaged position allowing pivoting of the upper part.

6 Claims, 3 Drawing Sheets

SIGHT MOUNT FOR FIRE ARMS

BACKGROUND OF THE INVENTION

1. Field of the Invention

The invention relates to a sight mount for fire arms such as hand guns and rifles, comprising a base part to be attached to a fire arm, an upper part to have a sight mounted thereon, and means for releasably locking the base part and the upper part together with the sight securely and accurately fixed in the intended operative position on the fire arm.

2. Description of the Prior Art

Many sight mounts for fire arms used today are of the kind referred to above and provide the advantage that several different sights can be mounted and that a sight to be used for the time being can be selected from said several sights and can be connected with a base part mounted on the fire arm. Thus, exchange of the sight in the operative position on the fire arm is greatly facilitated.

An example of a sight mount of the kind referred to is the Leupold sight with a rotary dovetail connection wherein the upper part is engaged with the base part and then is rotated in order to fixedly interconnect the upper and lower parts by dovetail engagement.

BRIEF SUMMARY OF THE INVENTION

One object of the invention is to provide a sight mount of the kind referred to which is of a simple construction and guarantees a reliable fixation of the sight in an accurately defined operative position on the fire arm, the sight mount at the same time allowing mounting of the sight on the fire arm and demounting of it therefrom by simple manipulation.

This object is achieved by a sight mount of the kind referred to which according to claim 1 is characterized in that the upper part is pivoted relative to the base part for movement about an axis between a first position corresponding to said operative position of the sight, wherein at least one projection on one of the upper part and the base part engages a groove on the other one of said parts, and a second position transverse to the first position, wherein the projection is disengaged from the groove to allow the upper part to be separated from the base part, and that said means comprises a latch which is spring biased to an engaged position preventing pivoting of the upper part from said first position, and against the spring bias can be brought into a disengaged position allowing pivoting of the upper part.

Preferred features of the invention are defined in the dependent claims.

BRIEF DESCRIPTION OF THE DRAWINGS

In the accompanying drawings which show an illustrative embodiment of the sight mount of the invention

DETAILED DESCRIPTION OF THE INVENTION

Further objects and features of the invention will be obvious to the skilled man from the description of the illustrative embodiment which follows.

Figure 1:
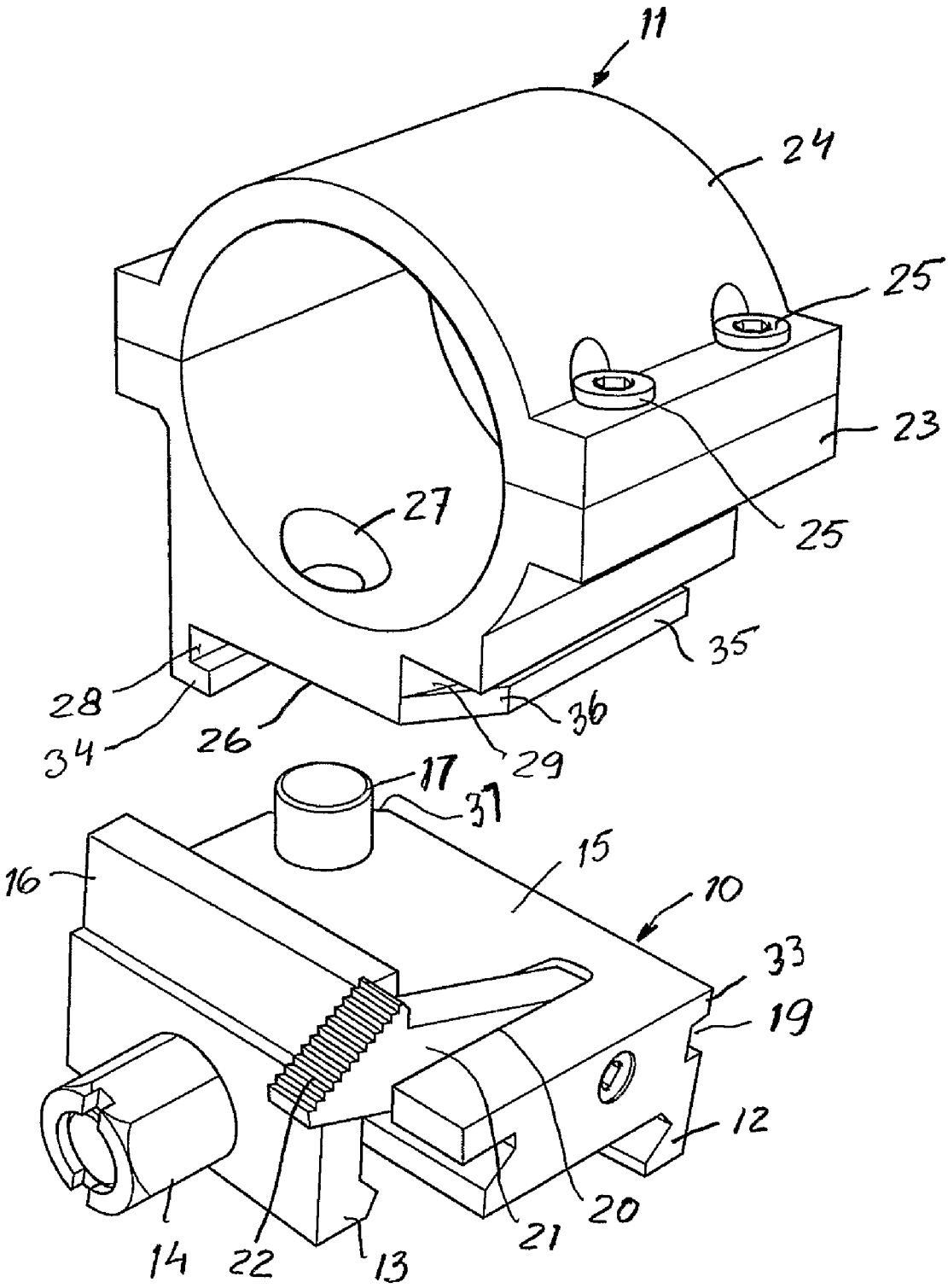
FIG. 1 is a perspective view of the sight mount with the base part and the upper part separated, the upper part being shown in a position transverse to the base part.
Figure 2:
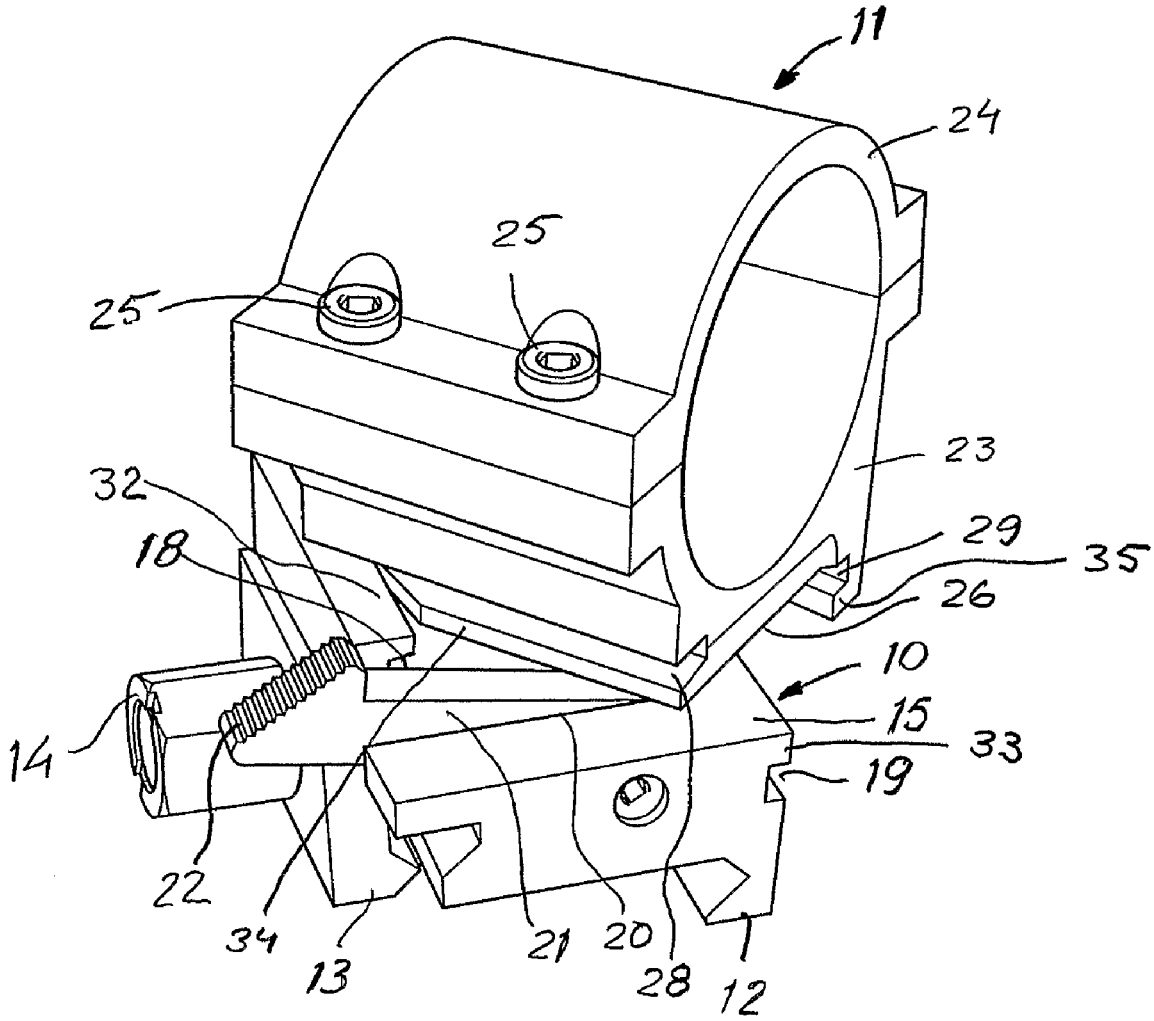
FIG. 2 is a perspective view of the sight mount with the two parts thereof interengaged and with the upper part partly turned to the operative position thereof.
Figure 3:
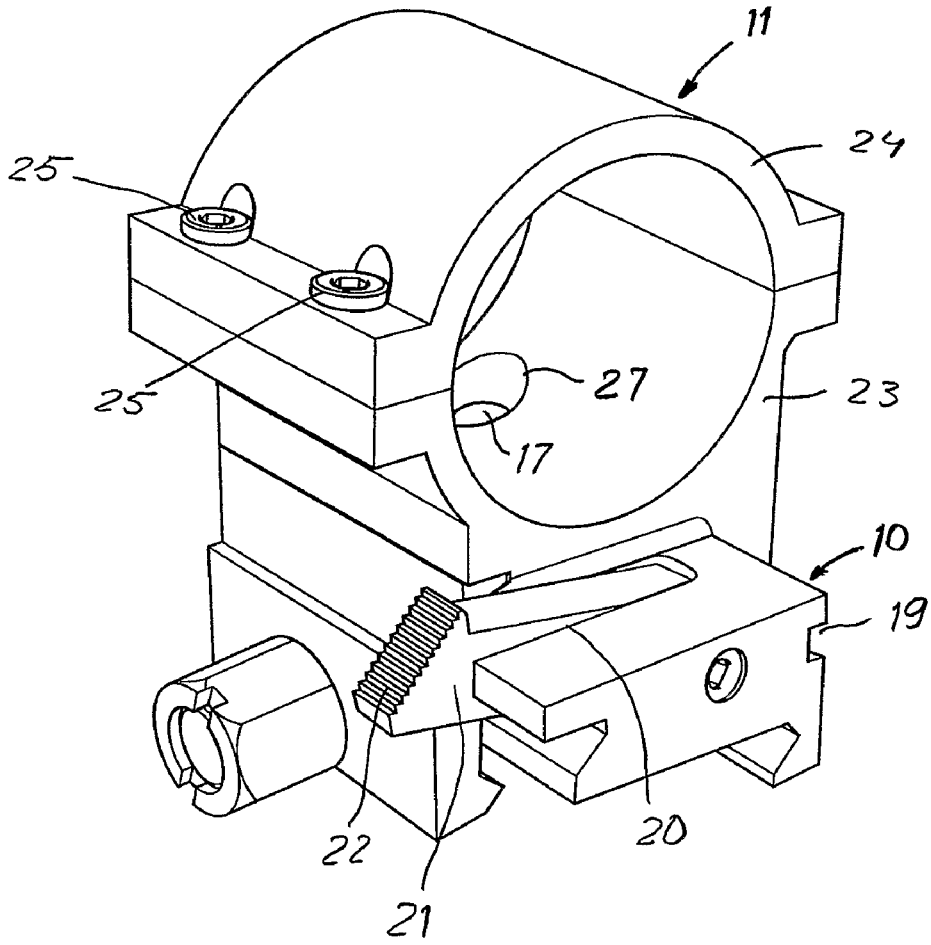
FIG. 3 is a perspective view of the sight mount with the parts thereof in the operative position.

The sight mount disclosed in the drawings comprises a base part 10 and an upper part 11 which are separate units as shown in FIG. 1 but can be connected with each other to form a single unit as shown in FIG. 3.

The base part 10 forms a jaw 12 and is provided with an adjustable jaw 13 cooperating with jaw 12, and by means of these jaws the base part 10 can be clamped to a rail attached to a fire arm such as a hand gun or rifle, jaw 13 being tightened by means of a screw connection 14. The base part forms a rectangular flat surface 15. A flange 16 projecting perpendicularly from said surface extends along one longitudinal edge of the surface. Also a cylindrical pin 17 projects perpendicularly from the flat surface adjacent the opposite longitudinal edge thereof. A groove 18 is defined by flange 16 and surface 15 along said one longitudinal edge, and a groove 19 is defined also in a side surface of base part 10 along said opposite longitudinal edge.

In a transverse slot 20 formed by the base part 10 and opening in the flat surface 15 there is pivotally mounted to the base part a latch lever 21 with a knurled finger grip 22. The latch lever is spring biased to be held in the position disclosed in the drawings but can be depressed against the spring bias to a position in which the latch lever except the finger grip 22 thereof is flush with the flat surface 15.

The upper part 11 comprises a split ring consisting of a semi-cylindrical bottom 23 and a semi-cylindrical cap 24 which are interconnected by means of screws 25. It is the intention that a sight shall be mounted to the upper part 11 of the mount by clamping the sight at a cylindrical portion thereof between the bottom and the cap when screws 25 are being tightened. Bottom 23 forms a flat underside surface 26, and a through circular aperture 27 matching pin 17 extends between surface 26 and the semi-circular inside surface of bottom 23. At each of the opposite longitudinal (axial) edges of surface 26 bottom 23 forms a groove 28 and 29, respectively.

Figure 4:
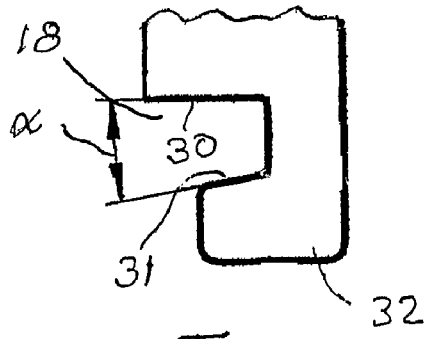
FIG. 4 is an enlarged cross sectional view of a groove.

Each of grooves 18, 19 and 28, 29 in the base part 10 and the upper part 11, respectively, are formed as shown in FIG. 4. For example, groove 18 is defined by one straight horizontal surface 30 used as a reference surface for measurements in manufacturing the mount, and one straight sloping surface 31 formed by a rib 32 defining groove 18 as seen in FIG. 1, the angle $\alpha$ being of the order of about 10°. In the same manner a sloping straight surface is formed by a rib 33 defining groove 19, a rib 34 defining groove 28, and a rib 35 defining groove 29. Each rib on one of the parts of the sight mount shall be received in an associated groove in the other one of said parts when the two parts of the mount are locked together.

When a sight attached to the upper part 11 is to be mounted on a fire arm, the upper part 11 in a transverse position relative to the base part 10 as shown in FIG. 1 is passed onto pin 17 which is received by aperture 27, and the flat underside surface 26 of part 11 is engaged with the flat surface 15 of the base part 10. Then, part 11 is rotated clockwise in relation to part 10 as seen in FIG. 1 about the axis of pin 17 rib 32 being received in groove 28, rib 33 in groove 29, rib 34 in groove 18 and rib 35 in groove 19. In order to make such rotation possible rib 35 is beveled at 36 and rib 33 is rounded at 37. During the rotation latch lever 21 either is held manually depressed against the spring bias at finger grip 22 or is depressed by cam action between part 11 and the latch lever. When part 11 is in a rotated position in which it extends longitudinally (axially) of part 10 the latch lever is released at the finger grip to return to the position shown in which the latch lever engages the adjacent end face of part 11, or the latch lever snaps back by the spring bias to said position shown when the upper part 11 arrives at the operative position of the sight. In this position the latch lever securely and accurately locks the upper part 11 in the intended operative position on the base part 10 in which the upper part extends longitudinally axially of the base part 10.

In order to remove the sight from the fire arm latch lever 21 must be depressed manually at finger grip 22 against the spring bias so that part 11 can be rotated counter-clockwise relative to part 10 about the axis of pin 17 in order to disengage the ribs and grooves from each other, part 11 in the transverse position shown in FIG. 1 being lifted from part 10.

The ribs engaging the grooves can be replaced by other suitable means preventing the upper part 11 from being lifted from the base part 10 in the operative position of the sight mount shown in FIG. 3 such as one or more pins or similar protrusions on one of parts 10 and 11 which engage the grooves in the other one of said parts.

The invention claimed is:

1. A sight mount for fire arms comprising a base part to be mounted on the fire arm, an upper part to have a sight mounted thereon, and means for releasably locking the base part and the upper part together with the sight fixed in the intended operative position on the fire arm, wherein the upper part is pivoted relative to the base part for movement about an axis between a first position corresponding to said operative position of the sight, wherein at least one projection on one of the upper part and the base part engages a groove on the other one of said parts, and a second position transverse to the first position, wherein the projection is disengaged from the groove to allow the upper part to be separated from the base part, and that said means comprises a latch which is spring biased to an engaged position preventing pivoting of the upper part from said first position, and against the spring bias can be brought into a disengaged position allowing pivoting of the upper part.

2. The sight mount of claim 1 wherein the latch can be brought into the disengaged position by manual operation.

3. The sight mount of claim 2 wherein the latch comprises a pivoted lever.

4. The sight mount of claim 3 wherein the lever in the engaged position engages an end face of the upper part in the operative position thereof to prevent pivoting of the upper part in relation to the base part.

5. The sight mount of claim 1 wherein the projections each comprise a rib matching the associated groove.

6. The sight of claim 1 wherein the upper part forms a flat underside surface to be engaged with a flat surface formed by the base part when the two parts are put together.

* * * * *